United States Patent [19]

Patterson et al.

[11] 3,997,027

[45] Dec. 14, 1976

[54] LADDER

[76] Inventors: Allen S. Patterson, 19151 S. Lake Shore Blvd., Euclid, Ohio 44119; Emanuel M. Trikilis, P.O. Box 116, Brunswick, Ohio 44212

[22] Filed: Nov. 4, 1974

[21] Appl. No.: 520,456

[52] U.S. Cl. ..... 182/195; 182/178; 182/46

[51] Int. Cl.[2] ..... E06C 7/08; E06C 1/08

[58] Field of Search ..... 182/228, 194, 217, 218, 182/219, 178, 46, 195; 256/65; 52/758 D; 403/199, 192, 381

[56] References Cited

UNITED STATES PATENTS

| | | | |
|---|---|---|---|
| 317,024 | 5/1885 | Schumann | 182/178 |
| 3,071,350 | 1/1963 | Opie | 256/65 |
| 3,468,093 | 9/1969 | Fuss | 182/228 |
| 3,502,173 | 3/1970 | Arnold | 182/228 |
| 3,559,763 | 2/1971 | Stern | 182/228 |
| 3,871,481 | 3/1975 | Balleck | 182/220 |

FOREIGN PATENTS OR APPLICATIONS

| | | | |
|---|---|---|---|
| 1,211,973 | 10/1959 | France | 182/228 |
| 513,857 | 10/1939 | United Kingdom | 182/228 |

*Primary Examiner*—Reinaldo P. Machado
*Attorney, Agent, or Firm*—Fay & Sharpe

[57] ABSTRACT

A ladder or ladder-like structure comprising at least one elongated, hollow extruded rail member of uniform cross-section throughout its length with at least one continuous longitudinally extending groove formed inwardly from the outer surface. The groove extends into the rail member and has an outer width which is narrower than its inner width. The rung members of the ladder are connected to the rail member by connector members which include a first portion having a shape generally corresponding to the shape of the groove and slidable longitudinally in the groove. To maintain a desired spacing between adjacent rung members, slidable spacer members are received in the groove and have a cross-sectional shape corresponding to the groove shape. Also, means are provided for preventing the spacer members and the connector members from sliding out of the groove.

9 Claims, 10 Drawing Figures

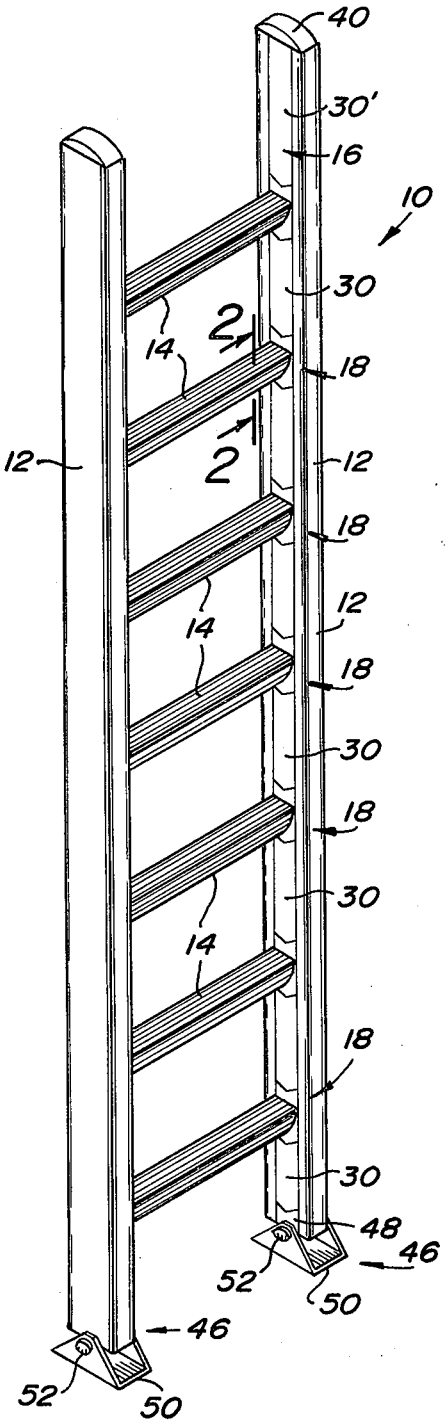
FIG. 1
FIG. 2
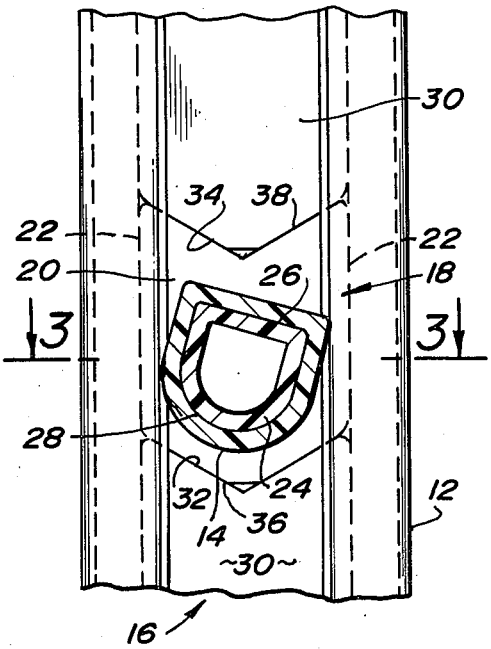
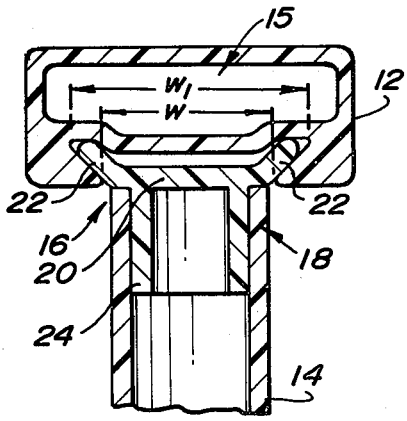
FIG. 3

LADDER

BACKGROUND OF THE INVENTION

The subject invention is directed toward the art of ladders and ladder-like devices and, more particularly, to improved ladder constructions which are formed from simple extruded and/or molded parts.

The invention will be described with respect to certain preferred embodiments; however, as will become apparent, the invention can be embodied in many forms of ladder-like structures.

In the past, many different materials have been used to form ladders. Most commonly, wood and aluminum have been the predominate ladder materials. The reasons for this are many; high strength to weight ratios, ease of forming the component parts, ease of assembly, good rigidity, etc.

Although plastic and various resins have been recognized as possessing desirable properties for ladder construction, to date attempts at forming ladders from them have not been particularly successful. Typical drawbacks to the successful use of plastics were high weight and fabrication problems. Additionally, although material costs were generally low, the cost of the ladders were not especially competitive because of the large and expensive dies and molds required.

A major portion of the problems involved with the prior unsuccessful use of plastics in ladder construction resulted from the fact that the designers merely adopted the same designs as were successfully used with aluminum or wood.

BRIEF DESCRIPTION OF THE INVENTION

The above-discussed problems are overcome by the subject invention which provides a ladder which preferably comprises at least one elongated, hollow extruded rail member of uniform cross-section throughout its length with at least one continuous longitudinally extending groove formed inwardly from the outer surface. The groove extends into the rail member and has an outer width which is narrower than its inner width. The rung members of the ladder are connected to the rail member by connector members which include a first portion having a shape generally corresponding to the shape of the groove and slidable longitudinally in the groove. Because of the configuration of the groove, the connector members and the associated rung members are prevented from being moved laterally out of the groove. To maintain a desired spacing between adjacent rung members, slidable spacer members are received in the groove and have a cross-sectional shape corresponding to the groove shape. The entire ladder is held in its assembled configuration by means such as stop-blocks or the like which prevent the spacer members and connector members from moving out of the ends of the groove.

The arrangement of the invention is such that a variety of types and sizes of ladders can be formed from the same basic components. Additionally, there are no complicated assembly problems and the strength of the ladder does not depend upon adhesive bonding, weld joints, rolled joints, or mechanical fasteners such as bolts, screws or nails.

Many different features can be included on the ladder formed in accordance with the subject invention. According to one aspect of the invention, the ladder has only a single, main rail member with rungs extending laterally from both sides thereof. With this type of ladder, smaller handrails can be connected to the outer ends of the rungs with the central rail member constituting the main structural element of the ladder.

Accordingly, a primary object of the invention is the provision of a ladder construction which is particularly suited for forming ladders from plastic, although features of the invention can be embodied in metal ladders.

A further object of the invention is the provision of a ladder structure which can be formed in a variety of types and sizes from a limited number of components.

A still further object is the provision of a ladder construction in which the rungs are connected to the rail members by sliding connector members received within the longitudinal groove in the rail members.

BRIEF DESCRIPTION OF THE DRAWINGS

The above and other objects and advantages will become apparent from the following description when read in conjunction with the accompanying drawings wherein:

FIG. 1 is a pictorial view of a ladder constructed in accordance with the preferred embodiment of the invention;

FIG. 2 is a vertical cross-sectional view taken on line 2—2 of FIG. 1;

FIG. 3 is a cross-sectional view taken on line 3—3 of FIG. 2;

DETAILED DESCRIPTION OF THE PREFERRED EMBODIMENT

Figure 4:
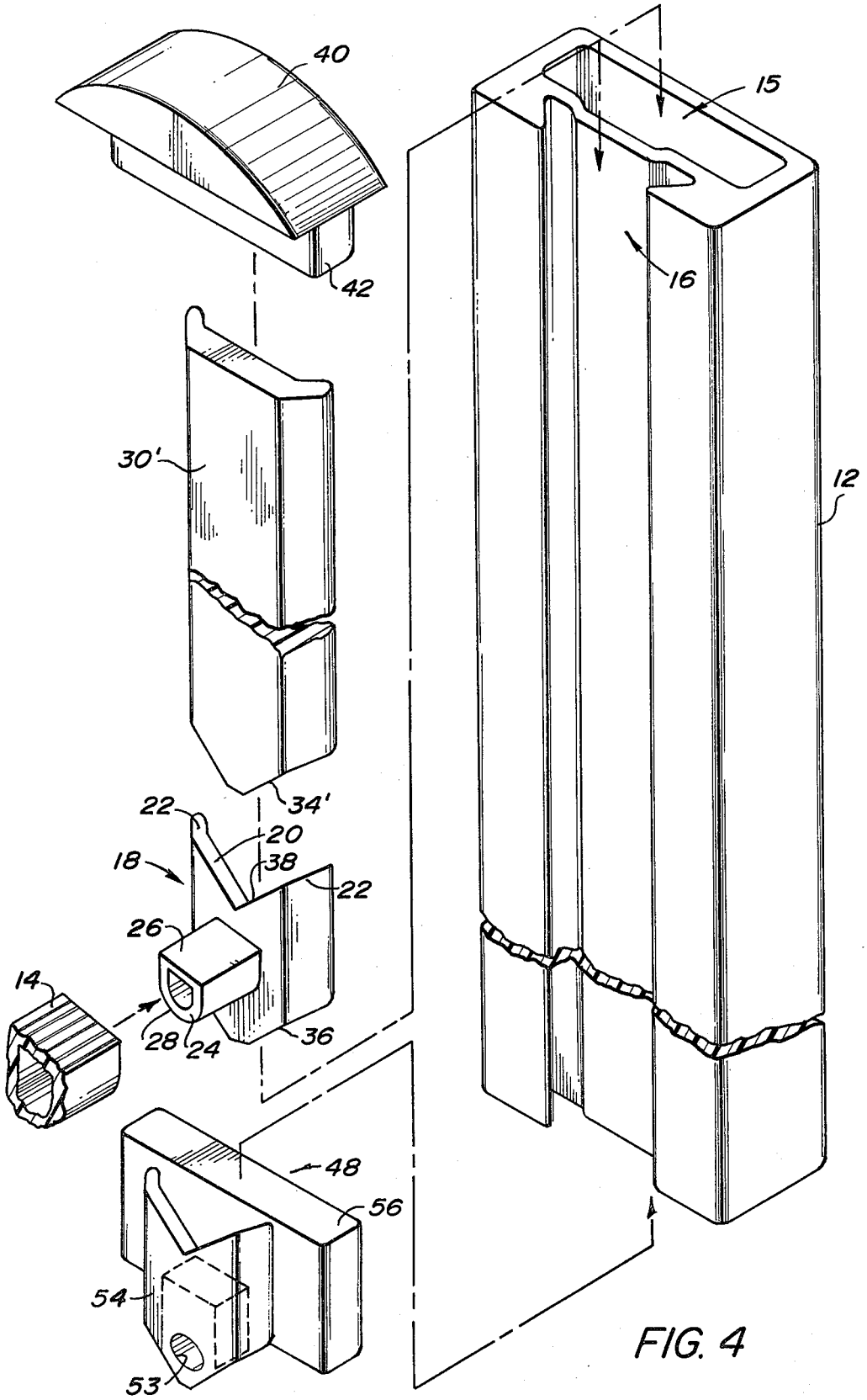
FIG. 4 is a pictorial view showing the relationship of the connecting members and the spacer members.

Referring more particularly to FIGS. 1–4, the preferred embodiment of the invention is shown as comprising a ladder 10 having a pair of spaced side rail members 12 interconnected by a plurality of transversely extending, generally parallel, rung members 14. In the embodiment under consideration, all major components of the ladder 10 are formed from a plastic, such as, high-density polyethylene. As will become apparent, however, other materials could equally well be used.

In the embodiment shown, the side rails 12 are of a uniform cross-sectional shape throughout their length and have the general configuration best shown in FIG. 3. As shown, the side rails 12 are hollow and each include a longitudinally extending center opening 15 and groove or recess 16 which is continuous throughout the length of the side rail. This particular type of side rail can be formed by conventional extrusion techniques. In the embodiment under consideration, the groove or recess 16 opens to the outer surface of the rail 12 and has an outer opening of a width $w$. Inwardly, the groove has a width $w_1$ which is, as shown, substantially greater than the width $w$. Broadly, the recess 16 has a somewhat trapezoidal shape.

To form the ladder 10, the rail members 12 are positioned with their respective grooves 16 facing and in generally aligned relationship. As shown, the rung members 14 extend transversely between the rails in alignment with the grooves or recesses 16. The ends of the rung members 14 are joined to the rail members by connecting members 18. As will be apparent, the connecting members could have a variety of constructions; however, the overall shape and configuration of the preferred form of the connecting members 18 is best illustrated in FIGS. 2–4. In particular, each of the connecting members 18 includes a first end portion 20 which comprises a pair of laterally inclined portions 22. The portions 22 are sized so as to be closely but slidably receivable axially in the recesses 16. Each of the connecting member 18 further include a slide or connecting end portion 24 which extends laterally out of the recess 16 when the connector is positioned therein. The end portion 24 is sized so as to be received within a corresponding opening formed in the end of an associated rung member 14. In the embodiment under consideration, each of the end portions 24 has a flat upper surface 26 and a semi-cylindrical lower surface 28. The particular shape of the end portions 24 is not, however, of importance to the subject invention. The shape illustrated is, however, preferred. The shape shown has been found to be particularly suited for this structure. Additionally, in the subject embodiment, the connectors 18 are formed from plastic through suitable injection molding techniques.

The rung members 14 are each preferably an extruded plastic member of uniform cross-sectional shape throughout its length. Additionally, rung members 14 are hollow and have an opening extending longitudinally therethrough which corresponds to the shape of the end portion 24 of the connectors 18. This permits the connectors to be received within the ends of the rungs and bonded thereto either through the use of a suitable adhesive or through conventional ultrasonic bonding techniques.

Although not of particular importance to the invention, it should be noted that in the embodiment under consideration, the end portions 24 of the connecting members 18 are rotated slightly so that their flat upper surface 26 is at an angle relative to the horizontal. This causes the corresponding flat upper surface or step portion of the rung members 14 to likewise be at an angle. This causes the top flat surface of rung member 14 to be nearly horizontal when the ladder is inclined in a normal operating position. This makes the rungs somewhat more safe and comfortable than a standard round rung. Additionally, it should be understood that other relationships could be provided for achieving a desired angular relationship of the upper surface of the rung members 14. For example, if desired, the connecting end portion 24 of the connectors 18 could be generally circular with a serrated or grooved upper surface. Of course, the interior of the end of the rung members would similarly be serrated. With this relationship, the rung members could be rotated to any desired angle during assembly of the ladder.

As noted above, the connecting members 18 are slidable longitudinally into the ends of the rail members 12. Similarly, the rung members are merely slid onto the end portions 24 of the connectors. In order to maintain a desired spacing between the adjacent rungs 14, suitable spacer members 30 are received in the grooves 16 between adjacent connectors 18. FIG. 4 illustrates the cross-sectional shape of the spacer members 30 which preferably corresponds in general to the cross-sectional shape of the first end portion 20 of the connector members 18. As can be appreciated, spacer members 30 are longitudinally slidable within the recess 16. Additionally, the opposite ends 32, 34 of the spacer members 30 are configured so as to mate with the ends of the connector members 18. As shown, the end 32 is recessed in a V-shaped configuration so as to mate with the end 36 of the connector 18. Similarly, the end 34 is of generally V-shaped configuration so as to mate with the V-shaped recess 38 of the upper end of the connectors 18.

The connectors 18 and the spacers 30 are maintained in position in the grooves 16 in any convenient manner. However, it is of particular importance that the connectors 18 and spacers 30 are prevented from having undesired longitudinal movement relative to the rails 12. In the subject embodiment, this is accomplished by suitable stop members mounted in the ends of the rails 12. Note that at the upper end of rails 12, a stop-block member 40 is provided with an end portion 42 which is received within the hollow opening 15 of the rail 12. After the connecting members and the spacers have been suitably positioned in the rail 12, the end stop member 40 is positioned in the end of the rail and joined thereto by adhesives, ultrasonic welding, or a suitable mechanical fastener. As shown, the uppermost spacer member 30′ is preferably flat at its upper end so as to mate with the under surface of stop block 40.

At the lower end of the rails 12, a stop-block member similar to stop-block member 40 could be used if desired. In the subject embodiment, however, the lower end is provided with an adjustable or pivotal shoe assembly 46 which includes a plastic block member 48 which extends upwardly into the ends of the rail and has a metal shoe or bracket 50 pivotally connected thereto through the use of a pin 52 which passes through an opening 53 in block member 48 (see FIG. 4). The block member 48 is provided with a pair of upwardly extending side-by-side portions 54 and 56. Portions 56 and 54 are sized so as to be freely receivable within the hollow opening 15 and the recess 16 of the rail 12, respectively.

Figure 5:
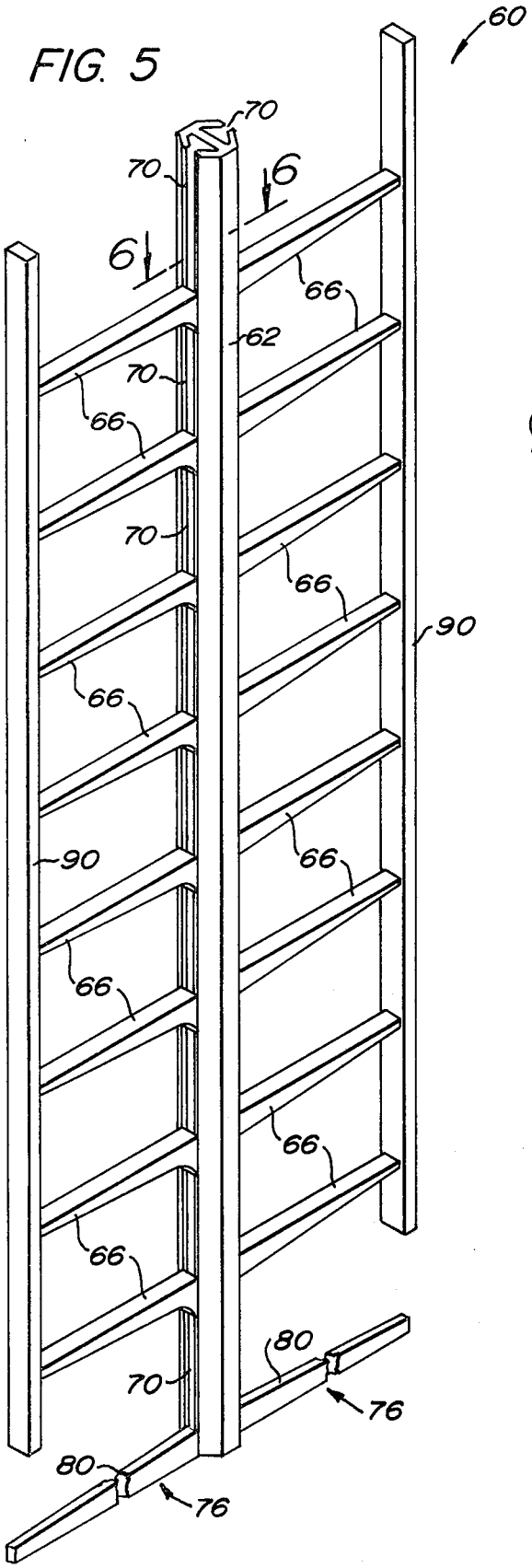
FIG. 5 is a pictorial view of a second embodiment of the invention.
Figure 6:
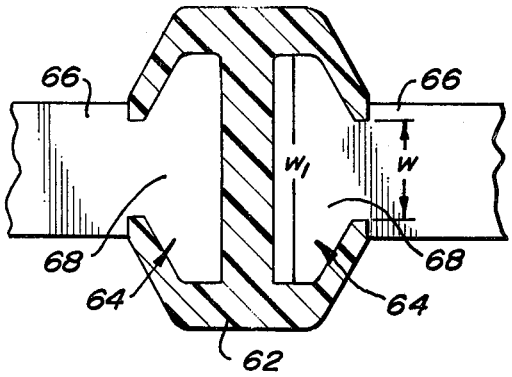
FIG. 6 is a cross-sectional view taken on line 6—6 of FIG. 5.

FIG. 5 shows a second embodiment of a ladder formed in accordance with the subject invention. As shown, the ladder assembly 60 comprises a main, vertically extending rail-like member 62 preferably extruded from a plastic or similar material having a uniform cross-section shape through its length. The rail member 62 is provided with a pair of opposed, longitudinally extending slots or grooves 64. The grooves 64 open to the outer surface of the member 62 on generally diagonally opposite sides. The outlet width W is substantially less than the inner width $W_1$. This gives the recesses 64 a somewhat trapezoidal or T-shape in cross-section.

Figures 7, 8:
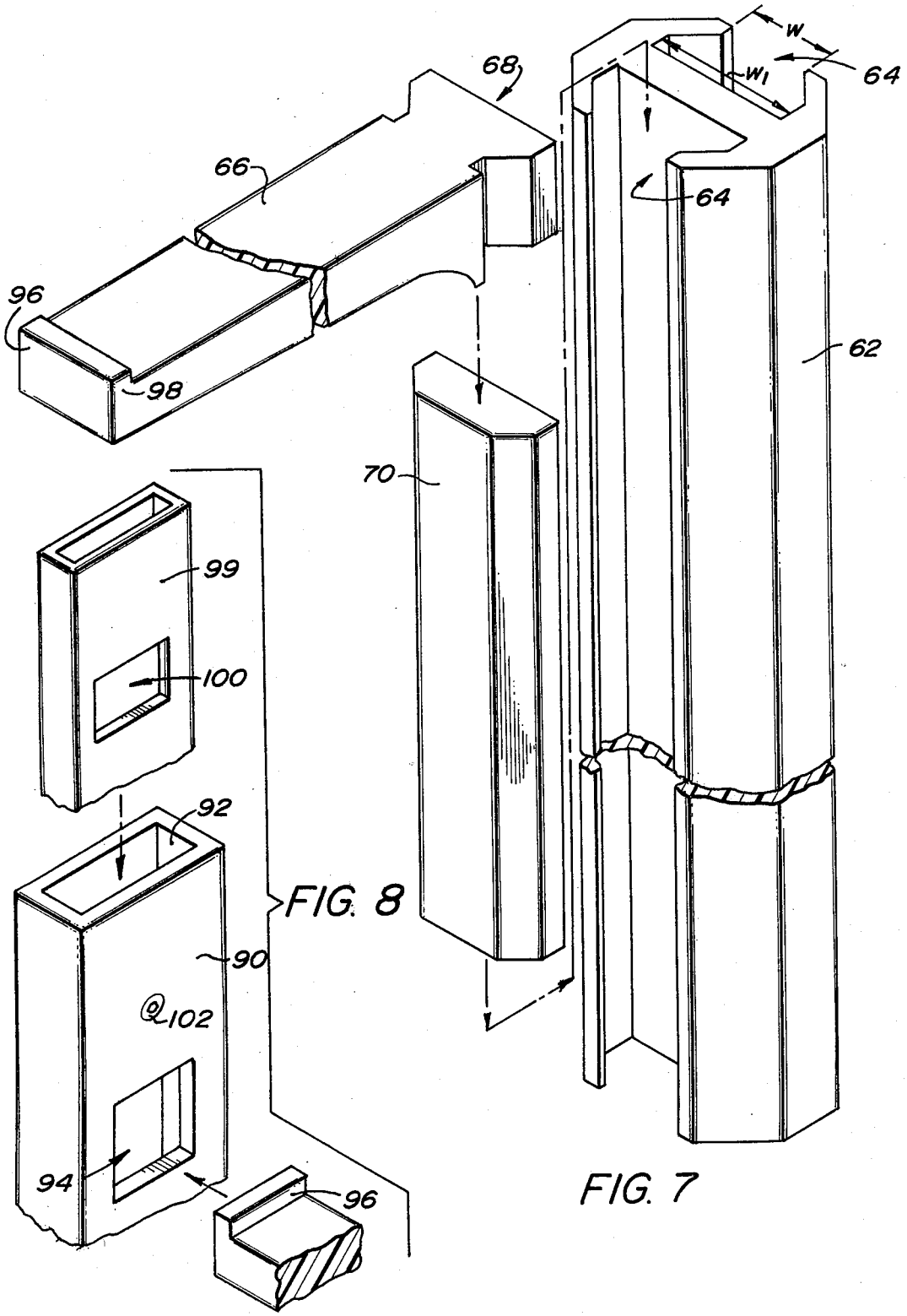
FIG. 7 is an exploded pictorial view showing the relationship between the main center rail, the rung members, and the spacer members of the FIG. 5 embodiment.
FIG. 8 is an exploded, partial pictorial view showing the relationship between the rung members and the handrails of the FIG. 5 embodiment; and, FIGS. 9 and 10 are pictorial views showing base members which can be used with the FIG. 5 embodiment.

A plurality of rung members 66 are mounted from the rail member 62. As shown, the rung members 66 extend laterally from each side of rail member 62. The overall shape and configuration of the rung members 66 is best illustrated in FIG. 7. It should be noted that each rung member 66 has a connecting member portion 68 formed integrally therewith. It should be understood that the connecting member 68 could be made separate from the main horizontal portion of the rung members 66, if desired. For example, the construction could be as discussed with reference to the FIG. 1 embodiment. Similarly, it should, of course, be understood that the FIG. 1 embodiment could have its rung and connecting members formed integrally as a single unit if desired. In particular, the connecting member 68 of rung members 66 are sized and shaped so as to be freely slidable within the vertical grooves or recesses 64. This permits the rung members 66 to be slid longitudinally into the main rail member 62 while preventing them from moving laterally out of the recess. The vertical spacing between adjacent rung members is maintained by spacer members 70 which have a cross-section generally corresponding to the cross-section of the recess 64. As best illustrated in FIG. 7, the spacer members 70 are slidably received with the recess 64 between the adjacent rung members 66. Thus, the rung members are maintained in a desired vertical spacing and prevented from sliding in the recess 64 after the ladder is in its assembled condition.

The ladder of embodiment 5 could be provided with stop-block members as discussed with reference to the FIGS. 1–4 embodiment. Alternately, the end spacer members 70 can be bonded into the grooves 64 to prevent any longitudinal movement of the spacer members and rung members.

Figure 9:
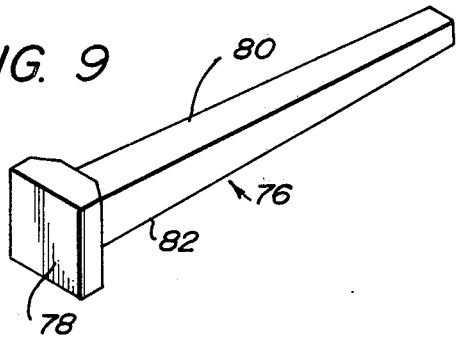

In order to assure a solid base and good lateral stability of the FIG. 5 embodiment, suitable base members 76 are connected at the lower end of the main rail member 62. FIG. 9 illustrates the shape and configuration of the base members 76. As shown, the base members 76 have a connecting end portion 78 configured so as to be slidably received within the grooves 64. A laterally extending portion 80 is formed integrally with the connector portion 78 and extends from the connector portion such that when assembled into the main rail member 62, its lower surface 82 is perpendicular to the longitudinal center axis of the main rail member 62. Thus, lateral tilting of the ladder is prevented by the base members 76. It should be appreciated that the connector portions 78 are suitably bonded or otherwise positively connected to the main rail member 62.

Figure 10:
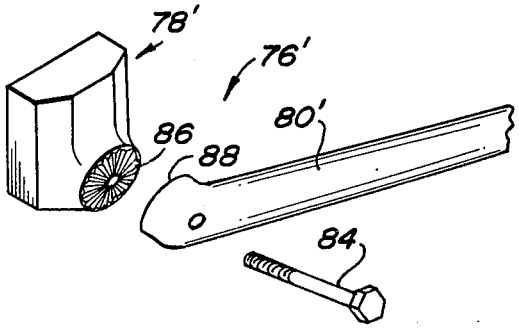

FIG. 10 shows an alternative construction for the base members. In this embodiment, the base member 76' includes a connecting block element 78' which is adapted to slidably fit within the recess 64. A separate base or leg element 80' is releasably connected from the associated connecting block member 78'. Any suitable form of connecting means such as a bolt 84 can be used for attaching the base member 80' to the connecting block member 78'. As shown, the mating surfaces 86 and 88 of the connecting block member 78' and the base element 80' are preferably provided with cooperating serrated surfaces 86, 88, respectively. This permits the base portion 80' to be adjusted to any desired angle relative to the main center rail 62.

It should be appreciated that two or more of the FIG. 10 base members are preferably used and adjusted to provide a "bird-form like" arrangement.

Referring again to FIG. 5, it will be seen that the ladder assembly 60 is illustrated as having a pair of vertically extending handrail members 90. It should be understood that the ladder assembly could be used without the handrail members 90 since the main structural support for the assembly is provided by the main center rail member 62. In certain instances, however, it is desirable to include the handrails 90. In the embodiment shown, the handrails 90 are of generally rectangular cross-section and are suitably joined to the outer ends of the rung members 66.

Many different types of connecting arrangements could be provided for securing the handrail members to the rung members. FIG. 8 illustrates one method by which the rung members can be connected in a releasable manner with the side rails 90. In particular, the side rails 90 comprise a continuous, hollow, rectangular extrusion having an open center 92. Suitable openings 94 are provided through the sides of the handrails 90. The openings 94 are sized and spaced so as to freely receive the ends 96 of the rung members 66. As shown, the ends 96 include an upwardly extending portion 98. Positioned within side rail 90 is a second rectangular extrusion member 99. Member 99 is arranged to be slidably received within opening 92 of handrail member 90. Suitable openings 100 are formed through the member 99 at spaced locations corresponding to the spacing between the rung members 66. With member 99 positioned within member 90 and the opening 100 aligned with the opening 94, the end 96 of the rungs can be moved into the aligned openings so that the upwardly extending flange portion is within the hollow center of member 99. With the end 96 in position, the members 99 can be slid downwardly. This locks the upwardly extending flange of the rung members into the side rail. To prevent movement of the locking member 99, suitable set screws or the like 102 can be tightened to hold member 99 in its locked position.

The invention has been described in great detail sufficient to enable one of ordinary skill in the art to make and use the same. Obviously, modifications and alterations of the preferred embodiment will occur to others upon a reading and understanding of the specification and it is our intention to include all such modifications and alterations as part of our invention insofar as they come within the scope of the appended claims.

What is claimed is:

1. A ladder or the like comprising; an elongated rail having opposite end portions and an outwardly opening longitudinal groove therein, said groove having an outer width W and an inner width $W_1$, which is greater then W, a plurality of one-piece longitudinally-spaced connector members having first end portions longitudinally slidably positioned in said groove against movement in any direction except longitudinally relative to said rail, each said connector member having a connecting end portion integral with said first end portion and extending outwardly from said groove generally perpendicular to said rail, an elongated rung connected to each said connecting end portion and extending generally perpendicular to said rail, each said rung having an open end receiving said connecting end portion on one of said connector members and being secured thereto against movement in any direction, spacer means longitudinally slidably positioned in said groove and longitudinally filling said groove between said connector members to maintain said connector members longitudinally spaced-apart, said connector members and spacer means substantially filling said groove longitudinally between said opposite end portions of said rail, and means adjacent said end portions of said rail for preventing said connector members and spacer means from sliding longitudinally out of said groove and thereby preventing longitudinal sliding movement of said connector members and spacer means relative to said rail.

2. The ladder of claim 1 and further including another said rail member to define a pair of rail members positioned in generally parallel spaced-apart relationship with said grooves therein facing one another, said grooves in each of said pair of rails having said connector members positioned therein, each said rung being open at both ends and receiving said connecting end portions, and said rungs substantially spanning said pair of rails.

3. The ladder of claim 2 wherein said rail members are positionable in an upright position inclined at an acute angle to the horizontal, said connecting end portions having flat upper surfaces extending generally horizontally when said rails are in said upright position, said rungs having an internal size and shape generally corresponding to the cross-sectional size and shape of said connecting end portions, said rungs having substantially flat upper outer surfaces which are longitudinally serrated, said connector members and rungs being of synthetic plastic material and said connecting end portions being bonded to said rungs.

4. The ladder of claim 2 wherein said spacer means comprises spacer members positioned in said grooves between said connector members, said connector members and spacer members having generally V-shaped projections and recesses at respective opposite ends thereof, said recesses and projections on said connector members respectively receiving and being received in corresponding projections and recesses in adjacent spacer members.

5. The ladder of claim 2 wherein said rails are hollow to define a longitudinally extending rail opening through each said rail, and said groove being located completely outside of said rail opening.

6. The ladder of claim 5 wherein said means for preventing said spacer means and connector members from sliding out of said grooves comprise stop blocks having portions received and secured in said rail openings at said opposite end portions of said rails and other portions stopping movement of said spacer means and connector members out of said grooves.

7. A ladder comprising; a pair of elongated rail members each having a longitudinally extending groove of uniform cross-sectional shape, said groove having an outwardly opening width W and an inner width $W_1$ which is greater than W, said rail members being spaced-apart with their grooves in facing generally aligned relationship, rung members extending transversely between said rail members in spaced-apart generally parallel relationship, said rung members being joined to said rail members by connector members at the ends of said rung members, said connector members having an enlarged end portion longitudinally slidably received in said grooves, spacer members slidably received in said grooves to maintain said connector members and said rung members spaced a predetermined distance apart, and means for preventing said spacer members and said connector members from moving longitudinally out of said grooves.

8. The ladder of claim 7 wherein said rails are hollow to define longitudinally extending internal openings, and said grooves being completely external of said openings.

9. The ladder of claim 8 wherein said rungs comprise hollow extrusions and said connector members have connecting end portions secured within the ends of said rungs.

* * * * *